US010556451B2

(12) United States Patent
Sumii

(10) Patent No.: US 10,556,451 B2
(45) Date of Patent: Feb. 11, 2020

(54) RECORDING APPARATUS

(71) Applicant: SEIKO EPSON CORPORATION, Tokyo (JP)

(72) Inventor: Atsushi Sumii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/200,720

(22) Filed: Nov. 27, 2018

(65) Prior Publication Data

US 2019/0160835 A1 May 30, 2019

(30) Foreign Application Priority Data

Nov. 29, 2017 (JP) ..... 2017-229251

(51) Int. Cl.
*B41J 11/04* (2006.01)
*B41J 3/60* (2006.01)
*B41J 13/00* (2006.01)

(52) U.S. Cl.
CPC ..... *B41J 11/04* (2013.01); *B41J 3/60* (2013.01); *B41J 13/0045* (2013.01)

(58) Field of Classification Search
CPC ..... B41J 11/04; B41J 13/0045; B41J 3/60
See application file for complete search history.

(56) References Cited

U.S. PATENT DOCUMENTS 8,573,769 B2 * 11/2013 Tanaka ..... B41J 13/106 347/101
9,475,667 B2 * 10/2016 Kodama ..... B65H 5/36
2010/0060693 A1 * 3/2010 Sugahara ..... B41J 3/60 347/16
2011/0267413 A1 * 11/2011 Nakano ..... B41J 13/0045 347/104
2012/0299992 A1 11/2012 Ue et al.

FOREIGN PATENT DOCUMENTS

JP 2004-051238 A 2/2004
JP 2012-245619 A 12/2012

* cited by examiner

*Primary Examiner* — Henok D Legesse
(74) *Attorney, Agent, or Firm* — Global IP Counselors, LLP

(57) ABSTRACT

A recording apparatus include a recording head that performs recording by ejecting ink onto paper from a plurality of nozzles, in which both a length of a first curved path in a first reverse path and a length of a second curved path in a second reverse path are longer than a distance of a head surface having a plurality of nozzles from a nip position in the pair of first feed rollers that transports paper toward the recording head to a position on the most downstream side in the medium transport direction. Further, a curvature of the second curved path is configured to be longer than a curvature of the first curved path.

14 Claims, 12 Drawing Sheets

RECORDING APPARATUS

CROSS REFERENCES TO RELATED APPLICATIONS

The entire disclosure of Japanese Patent Application No. 2017-229251, filed Nov. 29, 2017 is expressly incorporated by reference herein.

BACKGROUND

1. Technical Field

The present disclosure relates to a recording apparatus that performs recording on a medium.

2. Related Art

A recording apparatus represented by ink jet printer is configured to be capable of executing duplex recording in which recording is performed on a first surface of a medium by a recording head as a recording unit that performs recording on the medium and then the medium is fed to a reverse path to be reversed and is transported to a recording area of the recording head again, so that recording is performed on a second surface which is an opposite surface to the first surface (for example, JP-A-2012-245619).

Normally, the medium is configured to be fed to the recording area of the recording head by a transport means such as a pair of transport rollers provided on an upstream side of the recording head in a medium transport direction, and the like.

In such a recording apparatus, after recording is performed on the first surface of a medium, the first surface, which is a recording surface, absorbs ink and expands, and thus, the medium curls with the recording surface as an outside and with a non-recording surface as an inside. In a case where the medium curls when duplex recording is performed and the medium, after the first surface is recorded, is transported to a recording area with the second surface facing the recording head, a leading end of the medium floats up to approach the recording head side by the curling. A concern is that, as a result, the medium may rub against the recording head or paper jam may occur.

Therefore, for example, by reducing speed of, or stopping, transportation of a medium in the reverse path, curls are reduced or corrected in the related art. In this case, it is necessary to hold the medium in the reverse path for a long time when decurling the medium having a large curl which is caused by a large amount of ink ejected onto the first surface for printing, and thus, throughput in the recording apparatus is reduced.

On the other hand, JP-A-2004-51238 discloses a recording apparatus configured to feed the medium to either a smoothly curved reverse path or a sharply curved reverse path according to an amount of curl on the medium after the first surface is recorded on.

In a case where the amount of curl after the first surface is recorded on is large, the recording apparatus described in JP-A-2004-51238 can reduce time for decurling the medium by feeding the medium to a sharply curved reverse path.

In a case where a plurality of reverse paths are provided as in JP-A-2004-51238, in a part of a plurality of reverse paths (sharply curved reverse path, for example, in JP-A-2004-51238), a length of a curved portion that contributes to decurling is small such that decurling of the leading end of the medium may not be sufficient. In a case where decurling of the leading end of the medium is not sufficient, there is a concern that the leading end of the medium may come into contact with the recording head or be stuck inside the path to result in paper jam.

SUMMARY

An advantage of some aspects of the present disclosure is to provide a recording apparatus that includes a plurality of reverse paths in which, even in a case where the medium is reversed by any one of the reverse paths, the curl of the medium is properly corrected, and thus, the concern is alleviated that a second surface of the medium may come into contact with the recording head or that the medium may be stuck inside a path to result in paper jam.

According to an aspect of the disclosure, there is provided a recording apparatus including a recording head that is provided with a plurality of nozzles and performs recording by ejecting liquid onto a medium from the nozzles; a pair of transport rollers that transports the medium toward the recording head; and a first path and a second path that cause the medium, transported in the medium transport direction with a first surface facing the recording head, to be curved with the first surface being as an inside at a position on an upstream side of a position of the recording head in the medium transport direction, and reverse the medium so that a second surface which is a surface opposite to the first surface of the medium faces the recording head to transport the medium again toward the recording head, in which both a length of a first curved path included in the first path and a length of a second curved path included in the second path are longer than a distance from a nip position in the pair of transport rollers to a most downstream side position of a head surface having the plurality of nozzles in the medium transport direction, and in which a curvature of the second curved path is greater than a curvature of the first curved path.

With this configuration, both the length of the first curved path which is the curved path of the first path and the length of the second curved path which is the curved path of the second path are longer than the distance from a nip position in the pair of transport rollers to the most downstream side position of a head surface having a plurality of nozzles in the medium transport direction. Therefore, even when the medium is transported via the first path or the second path, it is possible to correct a curl over a range longer than a distance from a leading end of the medium to the most downstream side position of a head surface having a plurality of nozzles in the medium transport direction. Therefore, it is possible to alleviate the concern that the second surface of the medium nipped by the pair of transport rollers may rub against the recording head or that the medium may be stuck inside the path to result in paper jam.

Since the curvature of the second curved path is greater than the curvature of the first curved path, it is possible to correct a curl of the medium more efficiently in the second path that has the second curved path.

Furthermore, in a case of duplex recording where recording is performed on the second surface after the first surface is recorded on, it is possible to perform decurling efficiently by selecting the first path or the second path having a different curvature of the curved path depending on the recording on the first surface. Therefore, while alleviating the concern that the second surface of the medium may contact the recording head when recording is performed on the second surface, the throughput of the duplex recording is also improved.

In a case where duplex recording is executed in which recording is performed on the second surface of the medium after the first surface of the medium is recorded on, the medium may be reversed by the first path when an amount of liquid ejected onto the first surface of the medium is less than a predetermined threshold, and the medium may be reversed by the second path when the amount of liquid ejected onto the first surface of the medium is equal to or higher than the predetermined threshold.

A curl of a medium generated after the first surface of the medium is recorded on tends to become larger as the amount of the liquid ejected onto the first surface of the medium increases.

With this configuration, in a case where the amount of the liquid ejected onto the first surface of the medium is equal to or higher than a predetermined threshold and thus a curl of the medium becomes large, the curl can be reduced effectively since the medium is reversed by the second path that includes the second curved path of a high curvature, that is, a sharp curve.

On the other hand, in a sharply curved path, the medium being transported is easily stuck. IN this configuration, in a case where the amount of the liquid ejected onto the first surface of the medium is less than a predetermined threshold and, thus, a curl of the medium is small, the medium is reversed by the first path of a low curvature, that is, a smooth curve thereby alleviating the concern that the medium is stuck in the curved path.

The pair of transport rollers is configured to be capable of transporting the medium both in a medium transport direction toward a recording area of the recording head and in a switchback direction which is the opposite of the medium transport direction. The first path and the second path are configured to include the switchback path through which the medium being transported in the switchback direction passes by the pair of transport rollers, and to feed the medium to the first curved path and the second curved path via the switchback path.

With this configuration, in the recording apparatus configured to transport the medium from the recording area in a switchback direction and feed the medium to the first path or the second path, an operational effect similar to any one of the above can be obtained.

The length of path in a case where the medium, being transported in the switchback direction by the pair of transport rollers, is fed to the recording area via the first path may be set to be shorter than the length of path through which the medium is fed to the recording area via the second path.

With this configuration, since the length of path in a case where the medium, being transported in the switchback direction by the pair of transport rollers, is fed to the recording area via the first path is set to be shorter than the length of path in a case where the medium is fed to the recording area via the second path, the throughput of recording can be improved in a case where the medium is reversed by using the first path as compared with a case where the medium is reversed by using the second path.

The recording apparatus may further include a medium accommodation unit that accommodates the medium and a first transport path through which the medium transported from the medium accommodation unit passes. The switchback path may be connected to both the first curved path and an extension path which extends into the second curved path on the downstream side in the switchback direction. The first path may include the switchback path, the first curved path, and a second transport path that receives the medium from the first curved path and feeds the medium to the recording area of the recording head. The second path may include the switchback path, the extension path, the second curved path, a third transport path that receives the medium from the second curved path and merges with the second transport path, and the second transport path. The first transport path may merge with the first path after intersecting with the extension path.

With this configuration, since the first transport path that transports the medium from the medium accommodation unit to the recording head merges with the first path that has a short length to the recording area after intersecting with the extension path, it is possible to shorten a medium transport distance when recording is performed on the first surface. Therefore, excellent throughput can be obtained in the recording apparatus.

The first curved path may include a first roller that forms a path surface inside the curve; a first upstream side driven roller that nips the medium with the first roller in an upstream side end portion of the first curved path in the medium transport direction; and a first downstream side driven roller that nips the medium with the first roller in an downstream side end portion of the first curved path in the medium transport direction. The second curved path may include a second roller that forms a path surface inside the curve; a second upstream side driven roller that nips the medium with the second roller in an upstream side end portion of the second curved path in the medium transport direction; and the second downstream side driven roller that nips the medium with the second roller in a downstream side end portion of the second curved path in the medium transport direction.

With this configuration, a curvature of the first curved path can be defined by the first roller that forms a path surface inside the curve, and a curvature of the second curved path can be defined by a second roller that forms a path surface inside the curve.

The first curved path includes a first upstream side driven roller that nips the medium with the first roller in an upstream side end portion of the first curved path in the medium transport direction and a first downstream side driven roller that nips the medium with the first roller in a downstream side end portion of the first curved path in the medium transport direction. The second curved path includes a second upstream side driven roller that nips the medium with the second roller in an upstream side end portion of the second curved path in the medium transport direction, and a second downstream side driven roller that nips the medium with the second roller in a downstream side end portion of the second curved path in the medium transport direction. Therefore, it is possible to perform decurling of the medium effectively by transporting the medium firmly along each of the first curved path and the second curved path.

The recording apparatus may further include a third roller that is disposed on a downstream side in the medium transport direction with respect to the first roller and feeds the medium after a reversion toward the recording head side, and has a diameter same as that of the first roller.

With this configuration, in the recording apparatus configured to include a third roller which is disposed on a downstream side in the medium transport direction with respect to the first roller, transports the reversed medium toward the recording head side and has a diameter same as that of the first roller, an operational effect similar to the above is obtained.

The first path and the second path may be configured not to include a path that has a tendency to curl the medium such that the second surface side is rolled inward.

With this configuration, it is possible to alleviate a concern that the medium decurled by the first curved path of the first path or the second curved path of the second path returns back to a curled state.

According to another aspect of the disclosure, there is provided a recording apparatus including a recording head that includes a plurality of nozzles and performs recording by ejecting liquid onto a medium from the nozzles; a pair of first feed rollers that is disposed on an upstream side of the recording head in the medium transport direction and transports the medium to a recording area of the recording head; a pair of second feed rollers that is disposed on a downstream side of the recording head in the medium transport direction and transports the medium to the downstream side; and a first path and a second path that cause the medium, transported in the medium transport direction with a first surface facing the recording head, to be curved with the first surface being as an inside at a position on an upstream side of a position of the recording head in the medium transport direction, and reverse the medium so that a second surface which is a surface opposite to the first surface of the medium faces the recording head to transport the medium again toward the recording head, in which both a length of a first curved path included in the first path and a length of a second curved path included in the second path are longer than a length of a floating suppression area that is set between the pair of first feed rollers and the pair of second feed rollers, and a curvature of the second curved path is greater than a curvature of the first curved path.

With this configuration, since both a length of a first curved path which is the curved path of the first path and a length of a second curved path which is the curved path of the second path are longer than a length of the floating suppression area which is set between the pair of first feed rollers and the pair of second feed rollers, it is possible to correct a curl across a range longer than the length of the floating suppression area. Therefore, it is possible to alleviate a concern that the medium nipped by the pair of first feed rollers may float up in the floating suppression area to rub against the recording head.

Further, since the curvature of the second curved path is greater than the curvature of the first curved path, a curl of the medium can be corrected efficiently in the second path that has the second curved path.

Further, in a case of duplex recording in which recording is performed on the second surface after the first surface is recorded on, it is possible to perform decurling efficiently by selecting the first path or the second path having different curvature of the curved path depending on the recording on the first surface. Therefore, while alleviating the concern that the second surface of the medium may come into contact with the recording head when recording is performed on the second surface, throughput of the duplex recording is also improved.

The floating suppression area may be set in a range from a nip position of the medium in the pair of first feed rollers to the nozzle, out of the plurality of nozzles, which is positioned on the most downstream side in the medium transport direction.

With this configuration, the concern is alleviated that the medium nipped by the pair of first feed rollers may float up in a range from the nip position of the medium in the pair of first feed rollers to the nozzle, out of the plurality of nozzles, which is positioned on the most downstream side in the medium transport direction, and an operational effect similar to the above is obtained.

The floating suppression area may be set in a range from the nip position of the medium in the pair of first feed rollers to the nip position of the medium in the pair of second feed rollers.

With this configuration, it is possible to alleviate a concern that the medium nipped by the pair of first feed rollers may float up in a range from the nip position of the medium in the pair of first feed rollers to the nip position of the medium in the pair of second feed rollers, and to securely nip the leading end of the medium by the pair of second feed rollers while obtaining an operational effect similar to the above.

The recording apparatus may further include a second driven roller that constitutes the pair of second feed rollers and comes into contact with a surface of the medium on which recording is performed by the recording head to be driven to rotate; and a second driven roller support member that supports the second driven roller, and the floating suppression area is set in a range from a nip position of the medium in the pair of first feed rollers to a position of the second driven roller support member on a most upstream side in the medium transport direction.

With this configuration, it is possible to alleviate the concern that the medium nipped by the pair of first feed rollers may float up in a range from the nip position of the medium in the pair of first feed rollers to the most upstream side position of the second driven roller support member in the medium transport direction and to securely nip the leading of the medium by the pair of second feed rollers while obtaining an operational effect similar to the above.

The recording apparatus may further include a medium support member that is disposed to face the recording head and supports the medium, and the pair of first feed rollers is configured such that a tangent at a nip position where the medium is nipped intersects with the medium support member, and the floating suppression area may be set in a range from a position where the tangent intersects with the medium support member to the nozzle, out of the plurality of nozzles, which is positioned on a most downstream side in the medium transport direction.

In this configuration, the concern is alleviated that the medium nipped by the pair of first feed rollers may float up in a range from the position at which the tangent intersects with the medium support member to the nozzle, out of the plurality of the nozzles, positioned on the most downstream side in the medium transport direction, and an operation effect similar to the above is obtained.

The recording apparatus may further include a second driven roller that constitutes the pair of second feed rollers and comes into contact with a surface of the medium on which recording is performed by the recording head to be driven to rotate; a second driven roller support member that supports the second driven roller; and a medium support member that is disposed to face the recording head and supports the medium, and the pair of first feed rollers is configured such that a tangent at a nip position where the medium is nipped intersects with the medium support member, and the floating suppression area may be set in a range from a position where the tangent intersects with the medium support member to a position of the second driven roller support member on a most upstream side in the medium transport direction.

In this configuration, it is possible to alleviate the concern that the medium nipped by the pair of first feed rollers may float up in a range from the position at which the tangent intersects with the medium support member to the position of the second driven roller support member on the most upstream side in the medium transport direction, and to reliably nip the leading end of the medium by the pair of second feed rollers while obtaining an operational effect similar to the above.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

A recording apparatus according to a first embodiment of the disclosure will be described. An ink jet printer 1 (hereinafter, simply a printer 1) is taken to as an example of a recording apparatus.

Figure 1:
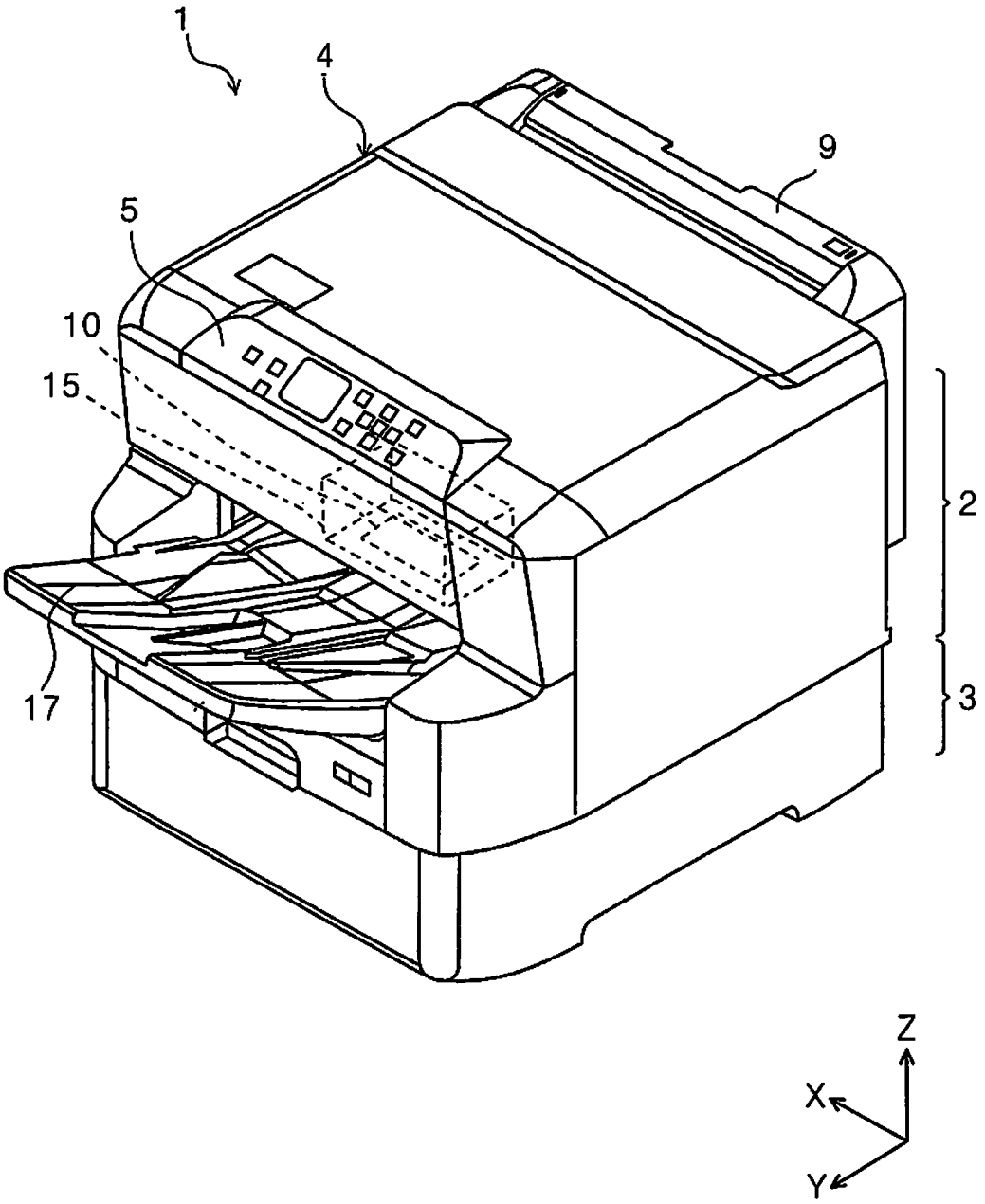
FIG. 1 is an exterior perspective view of a printer according to the present disclosure.
Figure 2:
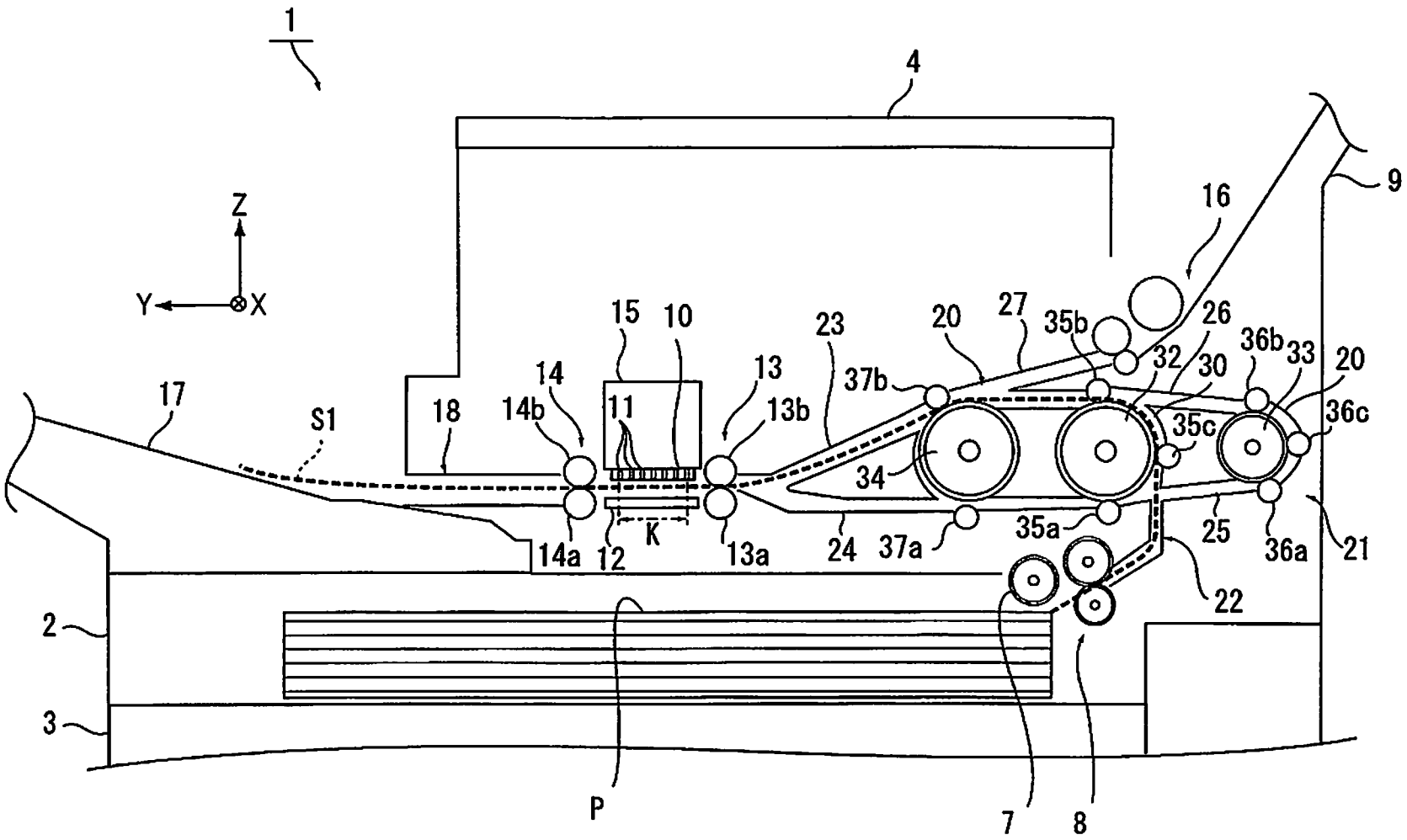
FIG. 2 is a schematic configuration view of the printer according to the disclosure.
Figure 3:
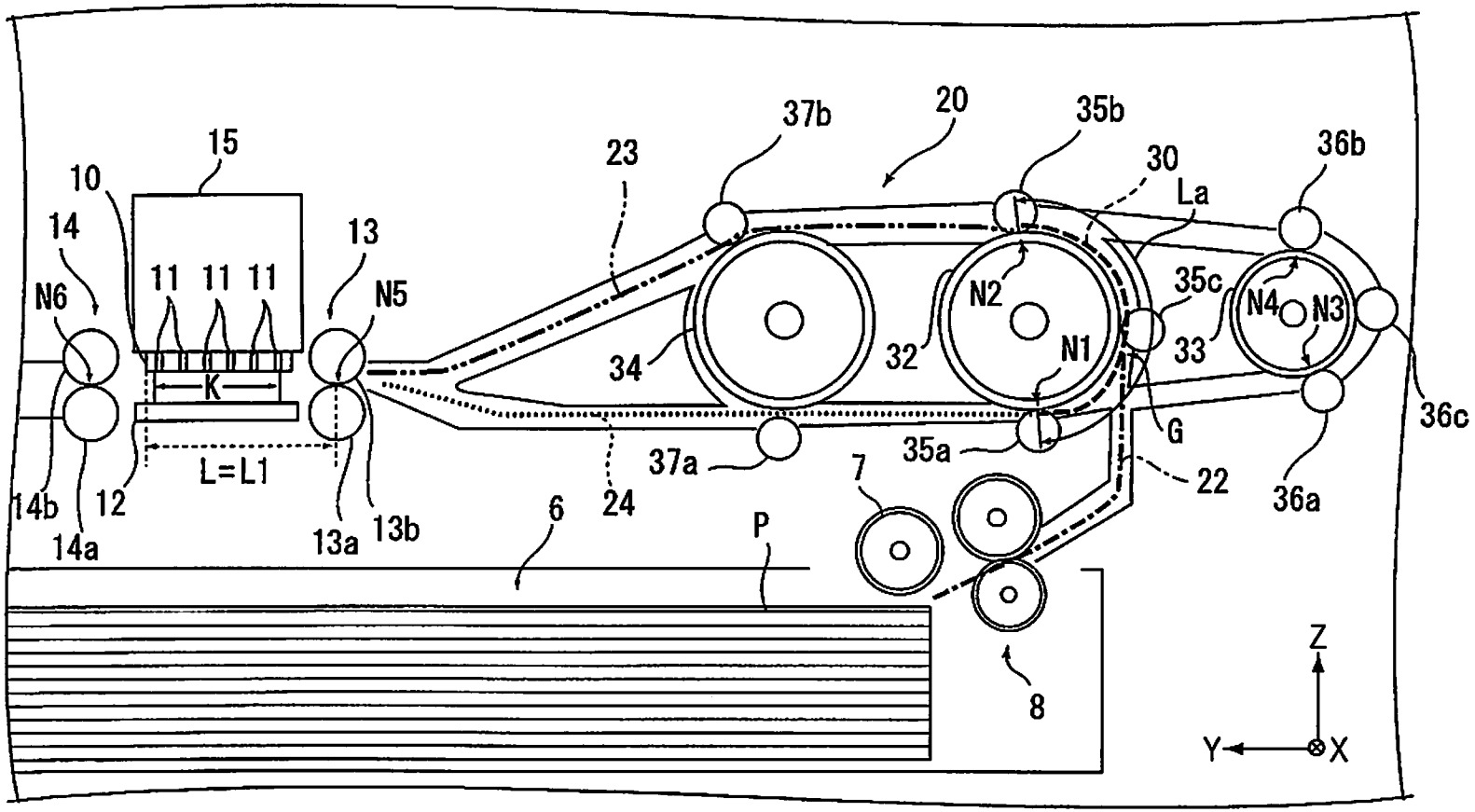
FIG. 3 is a view illustrating a first reverse path.
Figure 4:
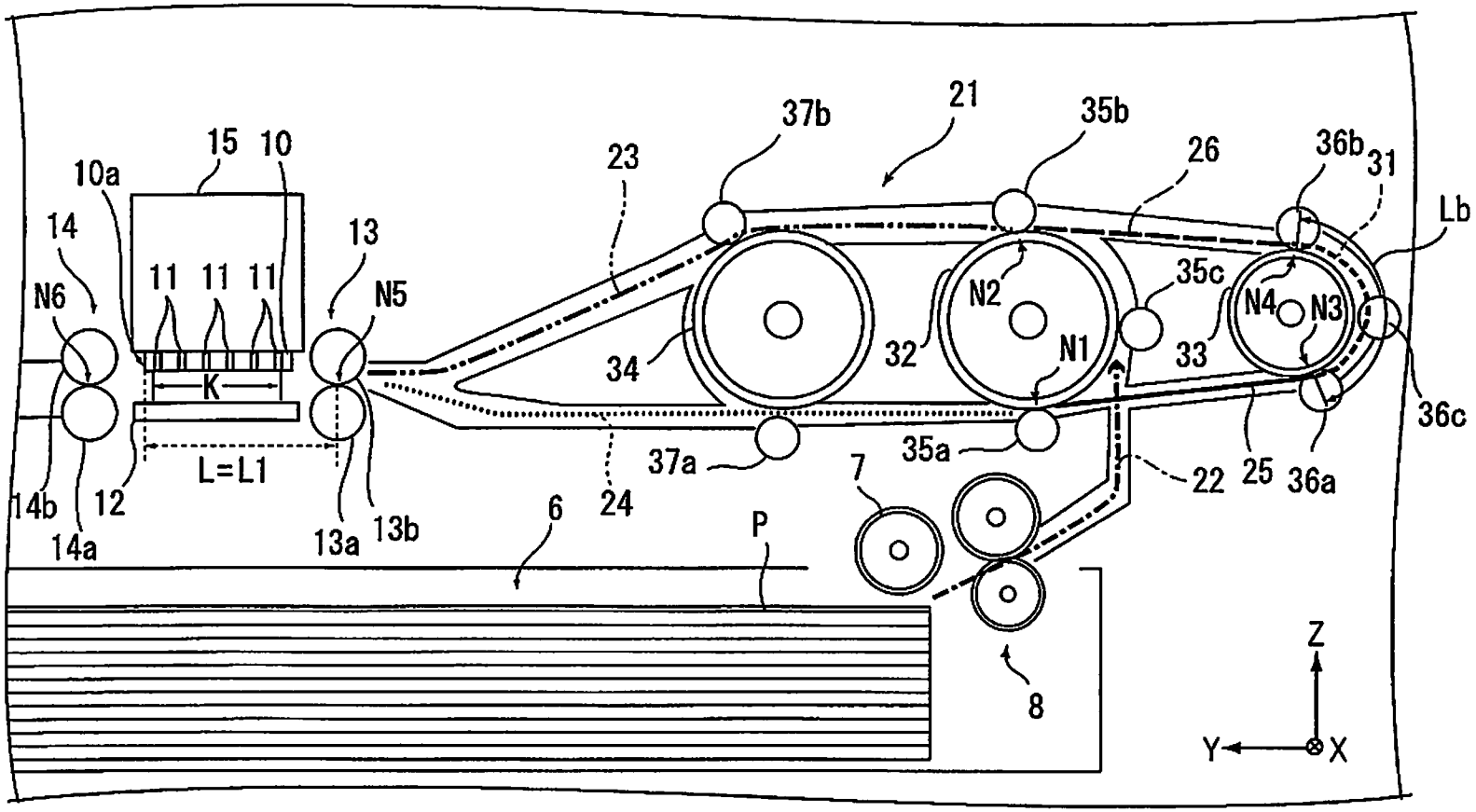
FIG. 4 is a view illustrating a second reverse path.
Figure 5:
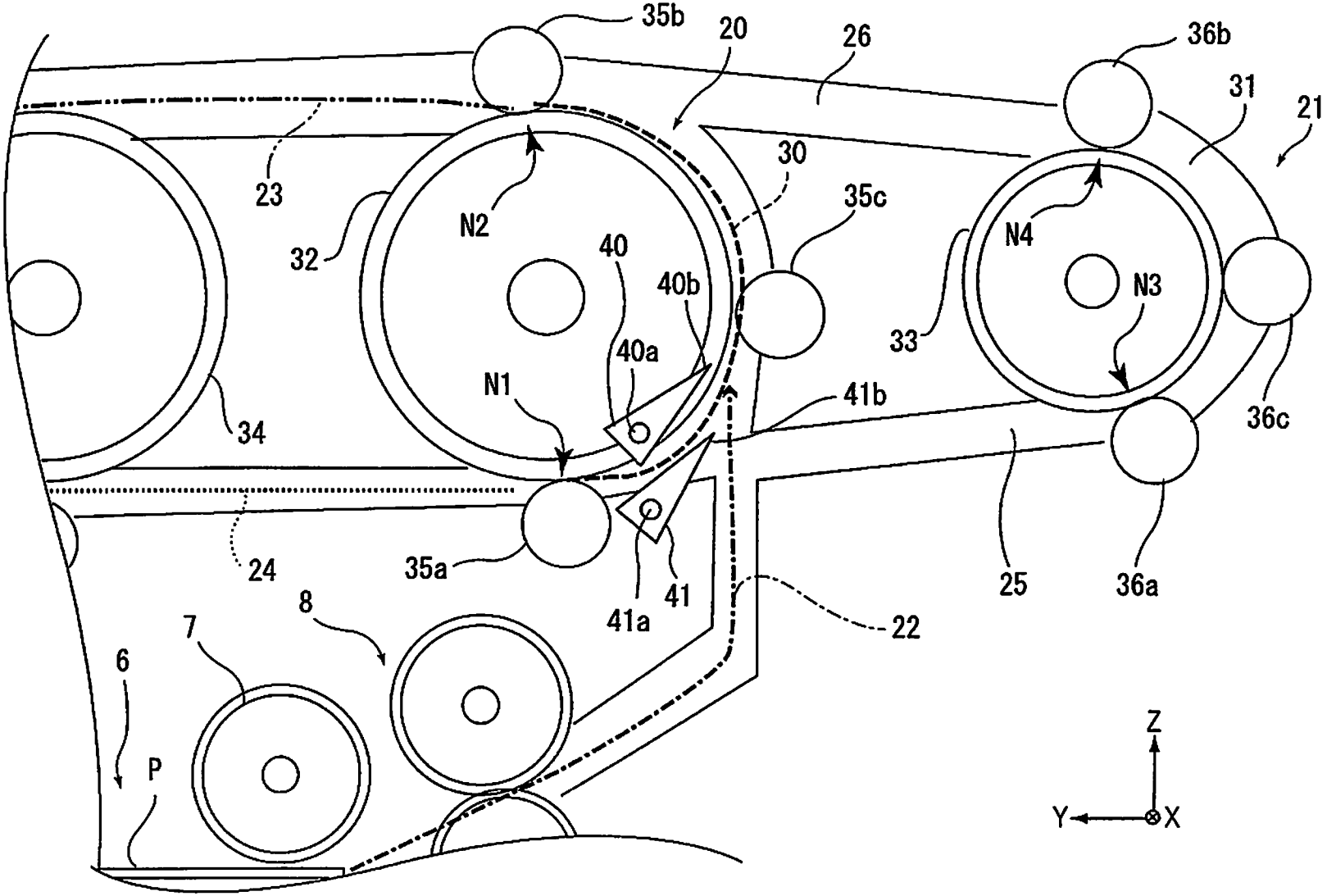
FIG. 5 is a view illustrating an operation of a first flap and a second flap when paper is transported to the first reverse path.

FIG. 1 is an exterior perspective view of a printer according to an aspect of the disclosure. FIG. 2 is a schematic configuration view of a printer according to an aspect of the disclosure. FIG. 3 is a view illustrating a first reverse path. FIG. 4 is a view illustrating a second reverse path. FIG. 5 is a view illustrating an operation of a first flap and a second flap when paper is transported to the first reverse path.

Figure 6:
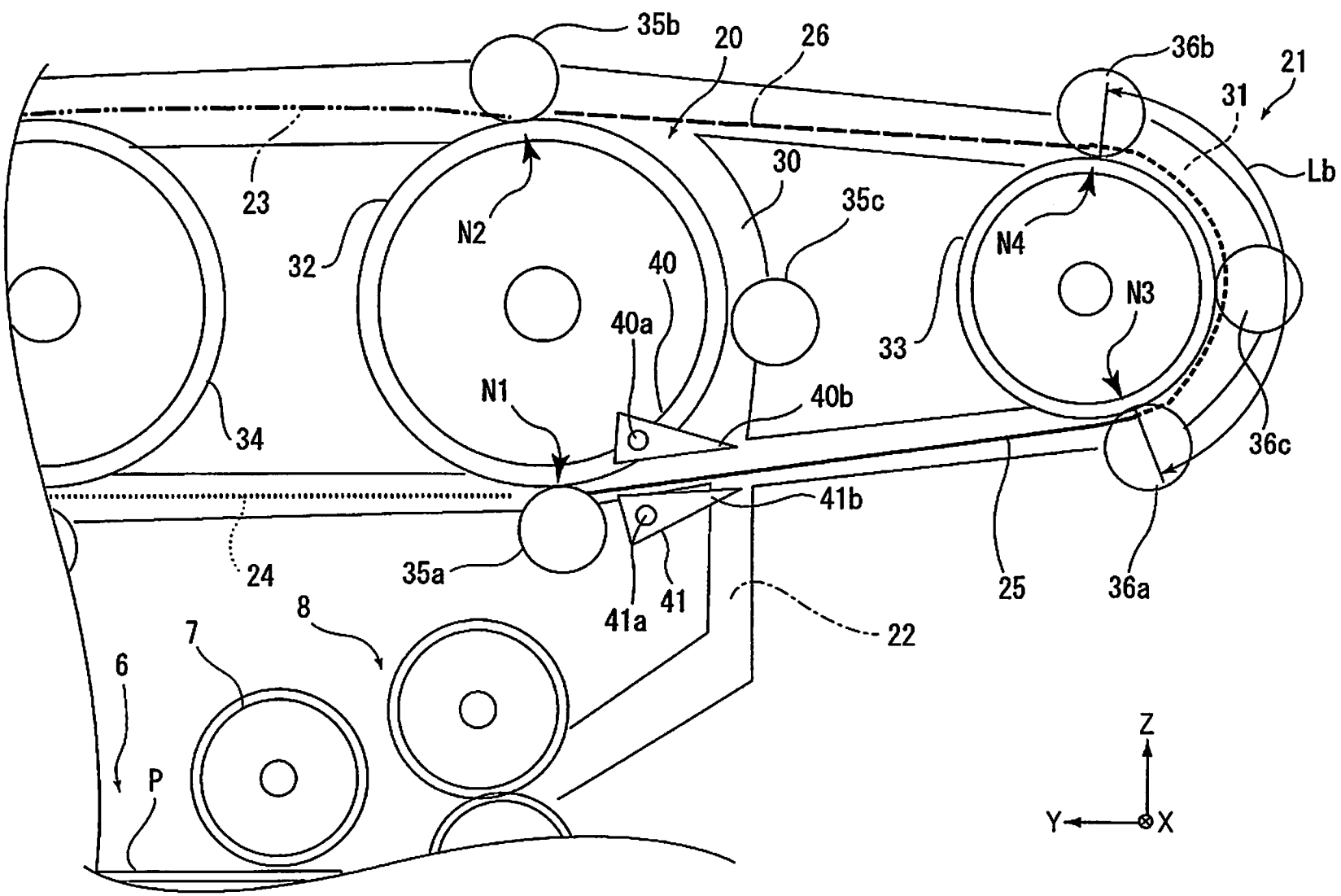
FIG. 6 is a view illustrating the operation of the first flap and the second flap when paper is transported to the second reverse path.
Figure 7:
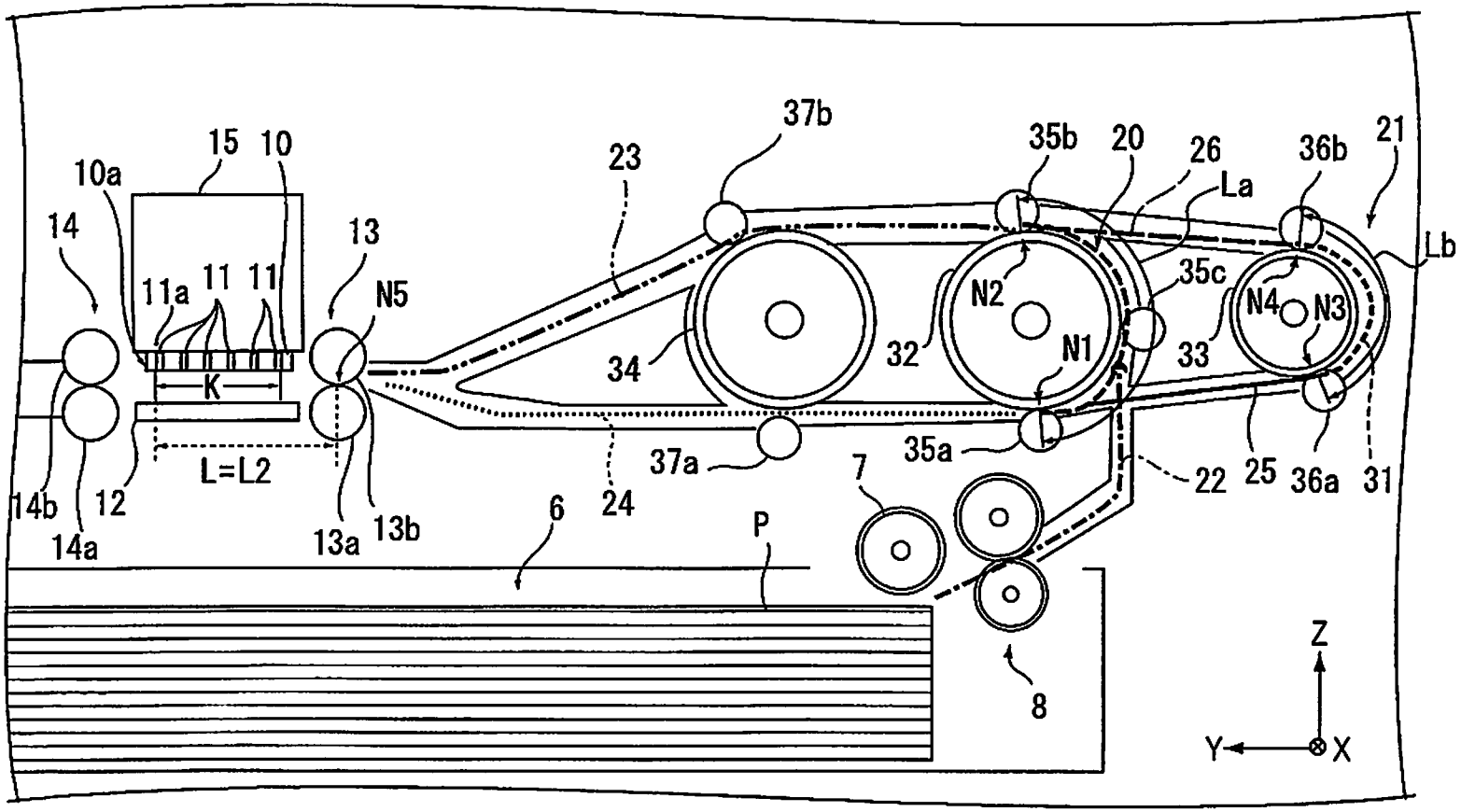
FIG. 7 is a view illustrating a first modification example of a floating suppression area L.
Figure 8:
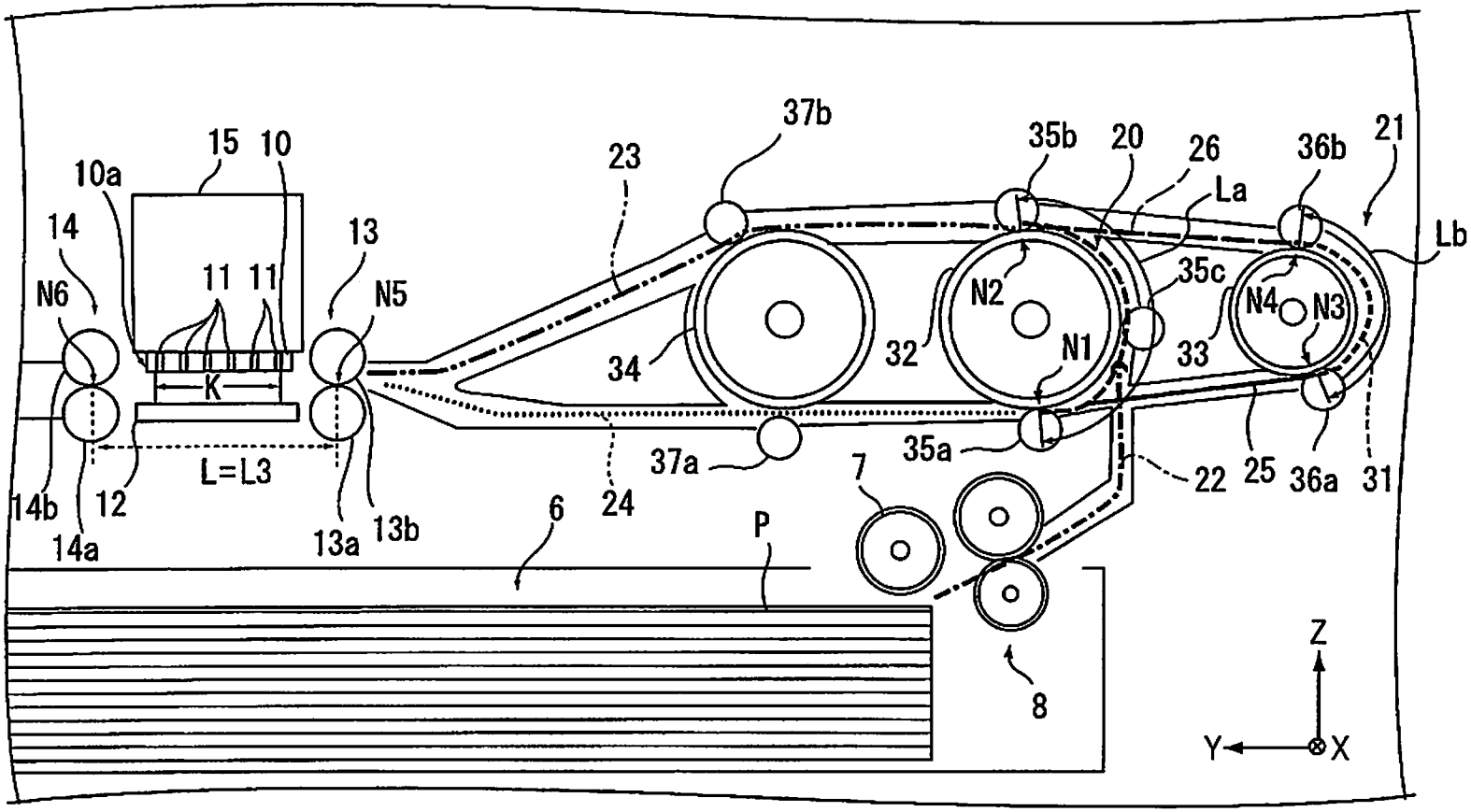
FIG. 8 is a view illustrating a second modification example of the floating suppression area L.
Figure 9:
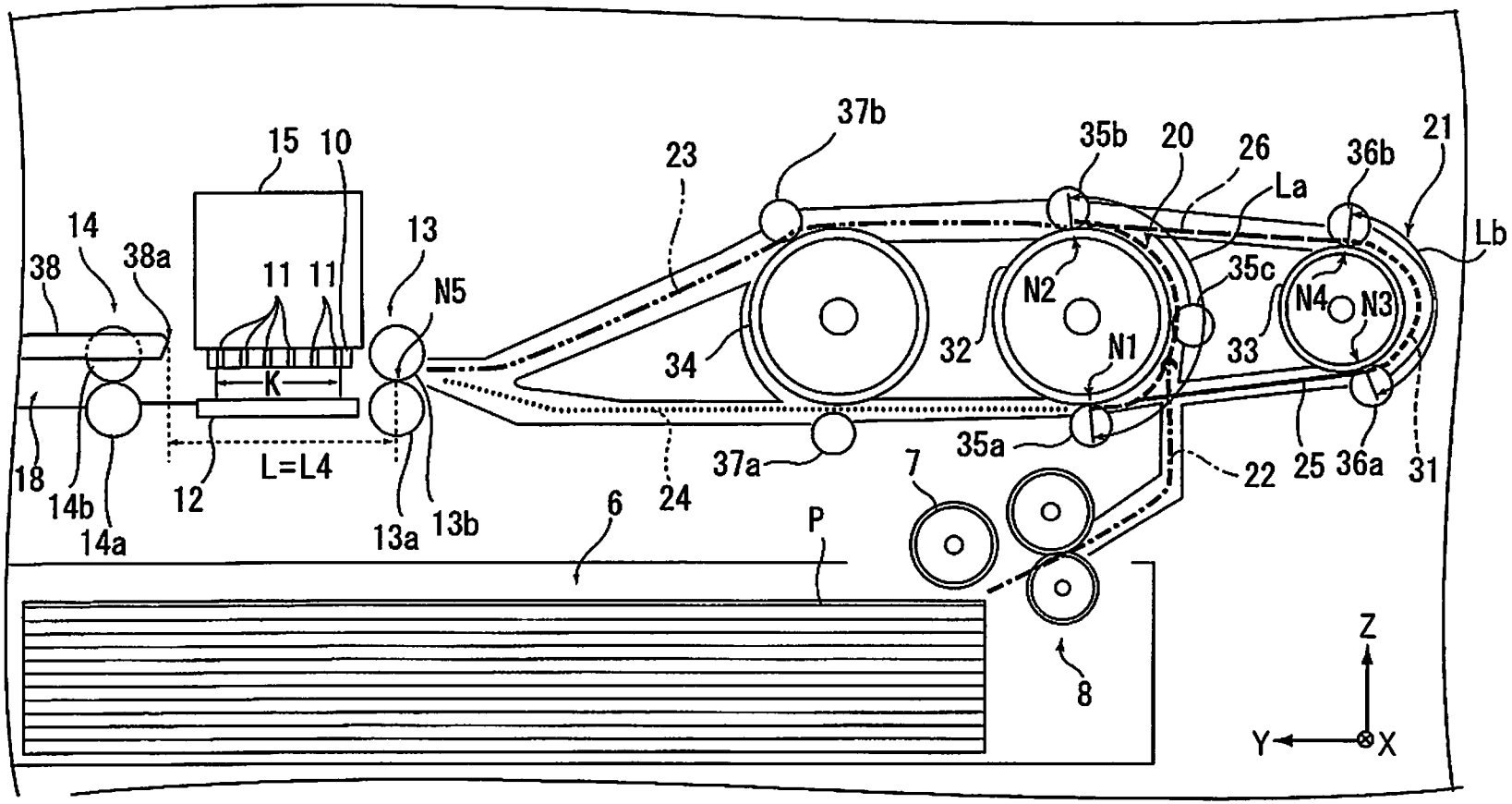
FIG. 9 is a view illustrating a third modification example of the floating suppression area L.
Figure 10:
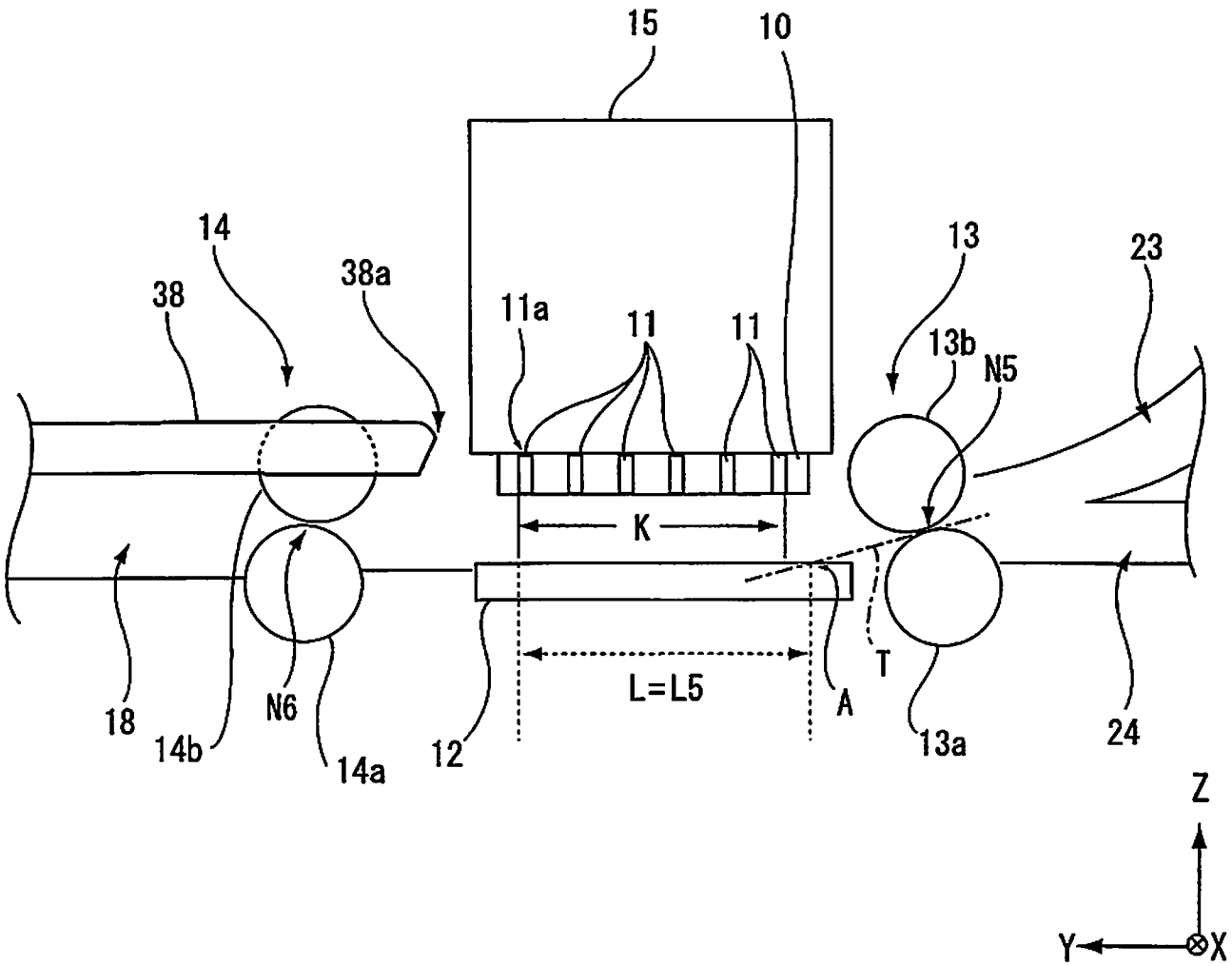
FIG. 10 is a view illustrating a fourth modification example of the floating suppression area L.
Figure 11:
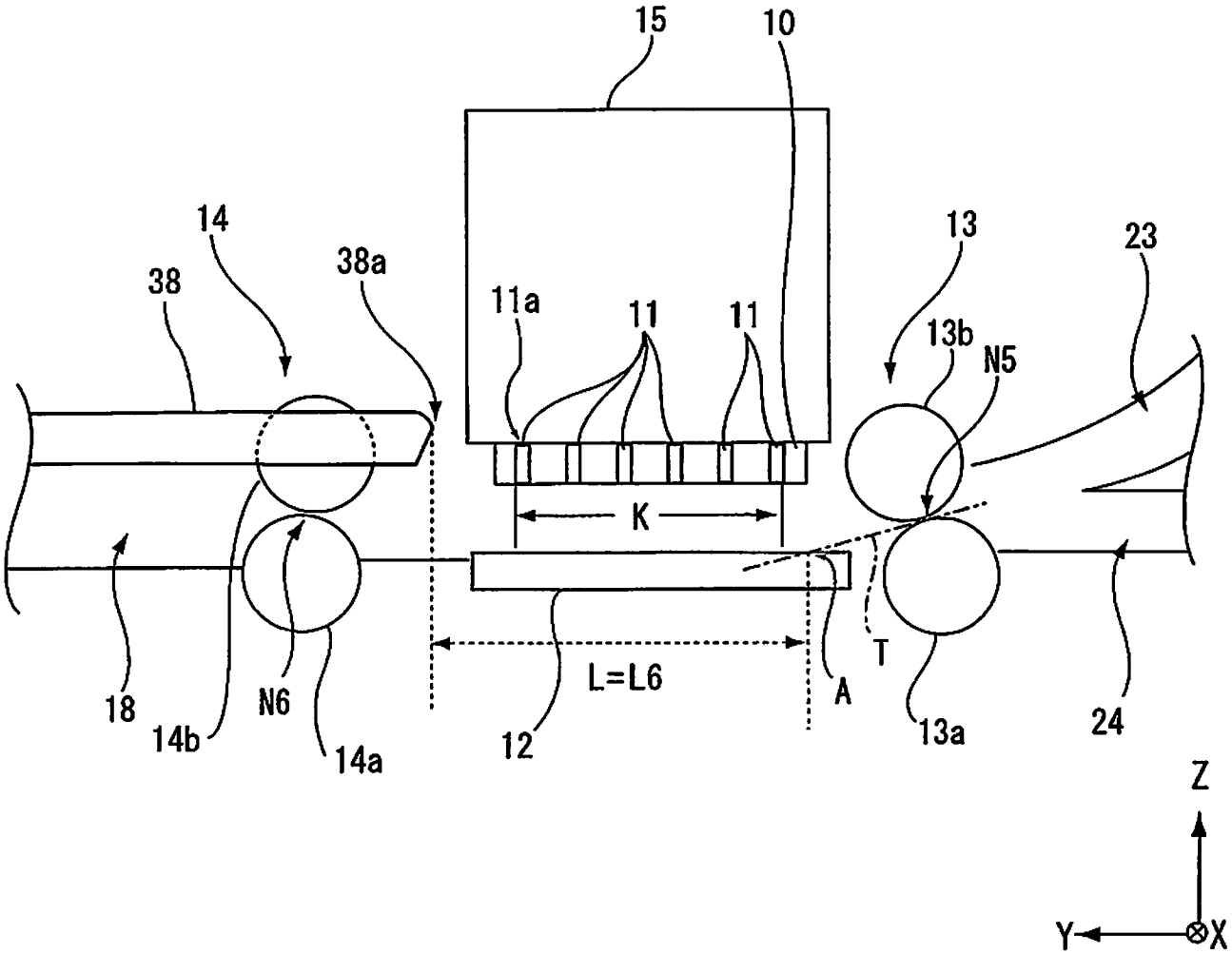
FIG. 11 is a view illustrating a fifth modification example of the floating suppression area L.
Figure 12:
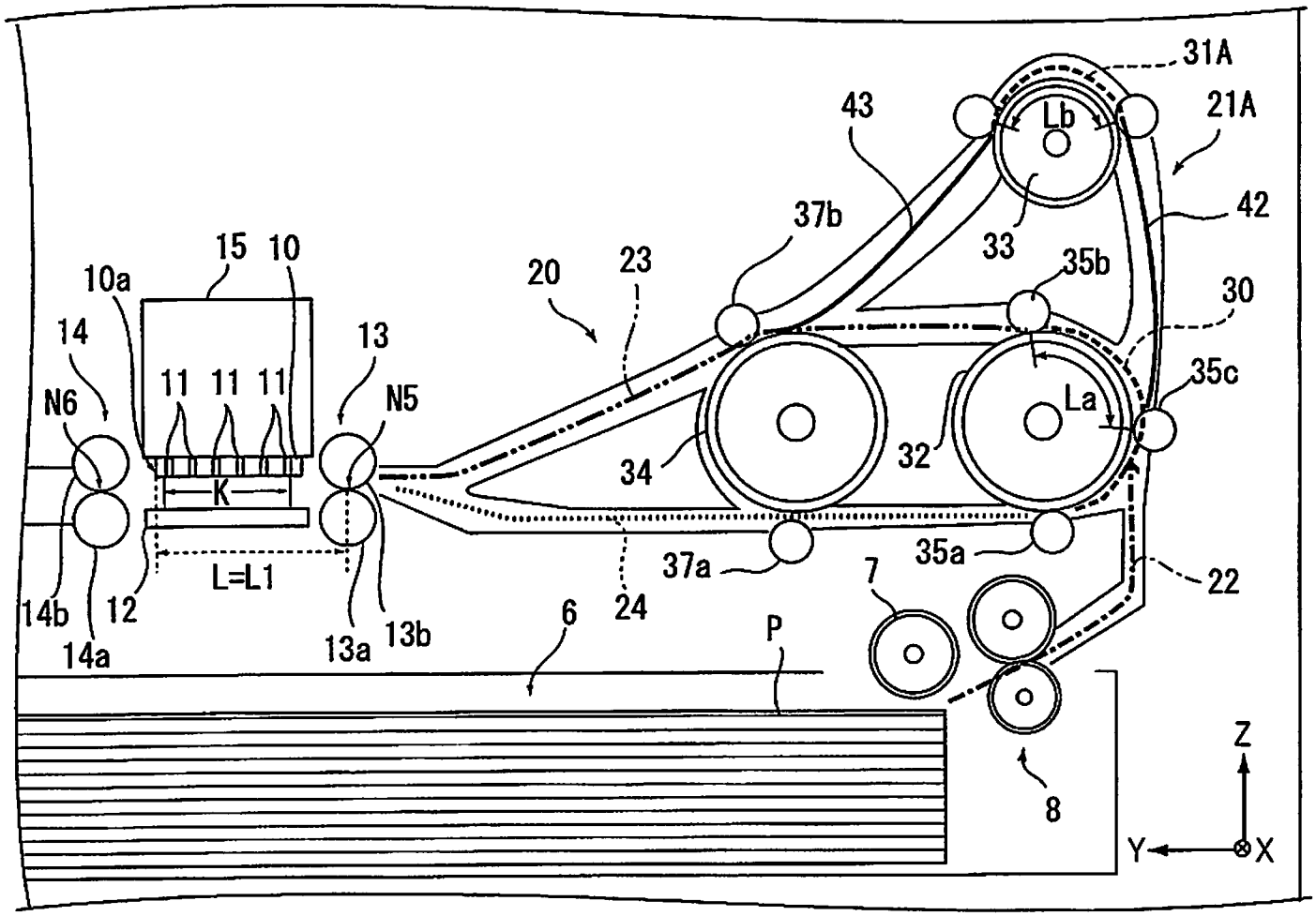
FIG. 12 is a schematic configuration view illustrating a case where a second roller is disposed above a first roller.

FIG. 6 is a view illustrating the operation of the first flap and the second flap when paper is transported to the second reverse path. FIG. 7 is a view illustrating a first modification example of a floating suppression area L. FIG. 8 is a view illustrating a second modification example of the floating suppression area L. FIG. 9 is a view illustrating a third modification example of the floating suppression area L. FIG. 10 is a view illustrating a fourth modification example of the floating suppression area L. FIG. 11 is a view illustrating a fifth modification example of the floating suppression area L. FIG. 12 is a schematic configuration view illustrating a case where a second roller is disposed above a first roller.

Further, in the X-Y-Z coordinate system illustrated in each drawing, the X direction is a scanning direction of a recording head and is a width direction of the medium on which recording is performed. The Y direction is an apparatus depth direction, and is the longitudinal direction of a medium. The Z direction is the direction of gravity and is a height direction of an apparatus. Further, the +Y direction side is a front surface side of the apparatus, and −Y direction side is a back surface side of the apparatus. Also, the left side seen from the front surface side of the apparatus is +X direction, and the right side seen from the front surface side of the apparatus is −X direction. In FIG. 2 which is a view illustrating the printer 1 with the front side thereof turned leftward as viewed from the side surface side, the depth side is +X direction and the front side is −X direction as viewed from the front of the figure. Also, +Z direction is an up side (including an upper part and an upper surface) of the apparatus, and −Z direction side is a down side (including a lower part and a lower surface) of the apparatus.

Further, in this specification, in the printer 1, a transport direction in which paper is transported is referred to as "downstream" and the opposite direction is referred to as an "upstream".

Overview of Printer

Hereinafter, an outline of the printer 1 will be described mainly with reference to FIG. 1. The printer 1 illustrated in FIG. 1 is configured to include a recording unit 2 and a liquid storage unit 3. The recording unit 2 includes a variety of constituent parts therein including a recording head 10 (denoted by a dotted line in FIG. 1) that performs recording on paper as a "medium." On the head surface (lower surface in FIG. 2) of the recording head 10, arranged side by side in the medium transport direction (Y axis direction), a plurality of nozzles 11 (FIG. 2) are provided. The recording head 10 is an ink jet type recording head that performs recording by ejecting ink as "liquid" onto paper from the nozzle 11. Examples of paper on which recording is performed in the printer 1 include plain paper, thick paper, photographic paper, and the like.

The printer 1 can be configured as a multifunctional apparatus that includes not only a recording function but also, for example, a document reading function, that is, a scanner. In the present embodiment, the scanner unit 4 is provided in an upper portion of the recording unit 2.

In the front surface side of the upper portion of the apparatus, an operation unit 5 for operating the printer 1 which includes the scanner unit 4 is provided.

In the liquid storage unit 3, a liquid container (not illustrated) that contains ink to be supplied to the recording head 10 is stored. The ink is supplied from the liquid container stored in the liquid storage unit 3 to the recording head 10 via a tube that connects the liquid container with the recording head 10.

The recording unit 2 is provided with a medium tray 6 as a "medium accommodation unit" that accommodates paper in the recording unit 2. The paper accommodated in the medium tray 6 is fed toward the recording head 10 and recording is performed.

It is also possible that the printer 1 is provided with an additional medium accommodation unit in the lower portion of the recording unit 2 or the lower portion of the liquid storage unit 3 in addition to the built-in medium tray 6 in the recording unit 2.

Paper Transport Path in Printer

Next, a medium transport path from the medium tray 6 (medium accommodation unit) will be described with reference to FIG. 2 and FIG. 3. In FIG. 2, description of the scanner unit 4 is omitted.

Printer 1 is configured to be capable of feeding paper P one by one from the medium tray 6 which is provided at the bottom of the recording unit 2. In FIG. 2, a path denoted by a reference symbol S1 is a path from the medium tray 6 to the recording area K of the recording head 10.

The paper P accommodated in the medium tray 6 is transported from the medium tray 6 to the first transport path 22 by a feed roller 7 (also referred to as a pickup roller). The first transport path 22 is a path through which the paper fed from the medium tray 6 passes (also refer to FIG. 3).

In a case where a plurality of pieces of paper P are picked up by the feed roller 7, the plurality of the pieces of paper are separated by a pair of separation rollers 8.

The first transport path 22, as illustrated in FIG. 3, merges with the first curved path 30 of the first reverse path 20 to be described later. The first transport path 22 is a path from the position of the feed roller 7 to the merging part G of the first curved path 30.

As illustrated in FIG. 2, paper is received from the first curved path 30 to the second transport path 23 (also refer to FIG. 3) and is fed to the recording area K of the recording head 10.

On the upstream side (the −Y direction side) of the recording head 10 in the medium transport direction, the pair of first feed rollers 13 is provided as "a pair of transport rollers" that transports paper toward the recording head 10. The pair of first feed rollers 13 is configured with the first drive roller 13*a* and the first driven roller 13*b*. The first drive roller 13*a* comes into contact with a surface opposite to the surface on which of paper recording is performed by the recording head 10, and the first driven roller 13*b* comes into contact with the surface on which recording is performed by the recording head 10 on paper to be driven to rotate.

On the downstream side (the +Y direction side) of the recording head 10 in the medium transport direction, the pair of second feed rollers 14 that transport paper to the downstream side is provided. The pair of second feed rollers 14 is configured with the second drive roller 14*a* and the second driven roller 14*b*. The second drive roller 14*a* contacts a surface opposite to the surface on which recording is performed by the recording head 10 on paper, and the second driven roller 14*b* comes into contact with a surface on which recording is performed by the recording head 10 on paper to be driven to rotate.

Below the recording head 10, that is, at a position facing the recording head 10, a medium support member 12 that supports paper P is provided. Recording is performed by ejecting ink from a plurality of nozzles 11 of the recording head 10 onto the paper that passes through the recording area K while being supported by the medium support member 12.

Further, in the medium support member 12, it is possible to provide an adsorption mechanism that adsorbs paper onto a supporting surface of the medium support member 12. In the adsorption mechanism, either suction adsorption or electrostatic adsorption can be used, for example.

The paper P after being recorded on by the recording head 10 is fed to paper discharge path 18 by the pair of second feed rollers 14 and is discharged to a paper discharge tray 17 provided on the front surface side of the apparatus. The paper discharge path 18 is a path from the pair of second feed rollers 14 to the paper discharge tray 17.

Here, the printer 1 is configured to be capable of duplex recording in which recording is performed on the second surface which is opposite to the first surface after the first surface is recorded on.

In a case where duplex recording is performed, after the first surface of paper is recorded on, the pair of first feed rollers 13 and the pair of second feed rollers 14 are reversely rotated to transport the medium back to either of the first reverse path 20 (the first path) illustrated in FIG. 3 and the second reverse path 21 (the second path) illustrated in FIG. 4. The configuration of the first reverse path 20 and the second reverse path 21 will be described later.

The pair of first feed rollers 13 and the pair of second feed rollers 14 are configured to be capable of transporting paper both in the medium transport direction (+Y direction) toward the recording area of the recording head 10 and in the switchback direction (−Y direction) which is opposite to the medium transport direction.

The first drive roller 13*a* and the second drive roller 14*a* are rotatably driven by a drive source (not illustrated), and, for example, in a case where the drive source is a motor, the motor is configured to be capable of rotating in both regular rotation and reverse rotation. Then, by switching the rotation direction of the motor, the rotation directions of the pair of first feed rollers 13 and the pair of second feed rollers 14 are switched. As a result, the pair of first feed rollers 13 and the pair of second feed rollers 14 become capable of transporting the paper P both in the medium transport direction (+Y direction) and in the switchback direction (−Y direction).

In the printer 1, operations related to recording are controlled by a control unit (not illustrated). The control unit controls recording by the recording head 10, movement of a carriage 15, and the like, in addition to the operation related to the transport of paper and driving of a variety of rollers such as the pair of first feed rollers 13, the pair of second feed rollers 14, and the like.

Further, in the printer 1, it is possible to perform feeding of paper by opening a manual feed cover 9 which is provided on the rear side of the upper portion of the apparatus as illustrated in FIG. 1 and by using a manual feed tray 16 (FIG. 2). The paper set in the manual feed tray 16 merges with the second transport path 23 from the manual feed path 27 and then is transported to the recording area K of the recording head 10. Incidentally, the description of the manual feed path 27 is omitted in figures following FIG. 3.

On the First Reverse Path and the Second Reverse Path

The printer 1 includes a curved path that bends paper to be transported by the pair of first feed rollers 13 such that the first surface (the surface facing upward) of the paper facing the recording head 10 is rolled inward, and is further provided with the first reverse path 20 (the first path) illustrated in FIG. 3 and the second reverse path 21 (the second path) illustrated in FIG. 4, both as a path that reverses the paper such that the second surface (the surface facing downward before the reversion), which is a surface opposite to the first surface of the paper, now faces the recording head 10.

In the present embodiment, both the first reverse path 20 (FIG. 3) and the second reverse path 21 (FIG. 4) are configured to include the switchback path 24, and to feed paper to the curved paths (the first curved path 30 in a case of the first reverse path 20 and the second curved path 31 in a case of the second reverse path 21) via the switchback path 24.

After the first reverse path 20 is described, the second reverse path 21 will be described in the following.

The First Reverse Path

In this embodiment, the first reverse path 20 illustrated in FIG. 3 is configured to include the switchback path 24 (dotted line in FIG. 3), the first curved path 30 (broken line in FIG. 3) and the second transport path 23 (two-dotted chain line in FIG. 3).

The switchback path 24 is a path through which paper to be transported by the pair of first feed rollers 13 in the switchback direction (−Y direction) passes and is connected to both the first curved path 30 (FIG. 3) and the extension path 25 (FIG. 4) that extends on the downstream side in the switchback direction into the second curved path 31 (FIG. 4) to be described later.

The switchback path 24 (FIG. 3) is a section from a nip position N5 of the pair of first feed rollers 13 to a nip position N1 of the first roller 32 and the first upstream side driven roller 35*a* to be described later.

The first curved path 30 (FIG. 3) is provided with the first roller 32 that forms a path surface inside the curve, the first upstream side driven roller 35*a* that nips paper with the first roller 32 in an upstream side end portion of the first curved path 30 in the medium transport direction, and the first downstream side driven roller 35*b* that nips paper with the first roller 32 in an downstream side end portion of the first curved path 30 in the medium transport direction. In other words, the first curved path 30 is a section from a nip position N1 of the first roller 32 and the first upstream side driven roller 35*a* to a nip position N2 of the first roller 32 and the first downstream side driven roller 35*b*. The length of the first curved path 30 (the length from the nip position N1 to the nip position N2) is La.

Reference numeral 35*c* denotes a driven roller that is provided between the first upstream side driven roller 35*a* and the first downstream side driven roller 35*b* and nips paper with the first roller 32 in the medium transport direction.

The first curved path 30 is configured to include the first roller 32, the first upstream side driven roller 35*a*, and the first downstream side driven roller 35*b*. It is possible to transport paper along the first curved path 30 more reliably and, thus, to perform decurling of paper effectively.

In addition, the curvature of the first curved path 30 is set to be lower than the curvature of the second curved path 31 of the second reverse path 21 illustrated in FIG. 4. That is, the first curved path 30 curves more smoothly than the second curved path 31.

The curvature of the first curved path 30 is defined by the first roller 32 that forms the path surface inside the curve.

The third roller 34 having the same diameter as the first roller 32 is disposed on the downstream side of the first roller 32 in the medium transport direction so as to feed the reversed paper toward the recording head 10. Reference numeral 37*b* denotes a driven roller 37*b* that nips paper with the third roller 34. The driven roller 37*b* is provided in the second transport path 23.

The second transport path 23 is a link from a nip position N2 of the first roller 32 and the first downstream side driven roller 35*b* to a nip position N5 of the pair of first feed rollers 13.

In this embodiment, the third roller 34 is a roller that transports paper in the switchback path 24. Reference numeral 37*a* denotes the driven roller 37*a* that is provided in the switchback path 24 and nips paper with the third roller 34.

Further, the first roller 32 and the third roller 34 are driven to rotate by a drive source (not illustrated).

The Second Reverse Path

The second reverse path 21 illustrated in FIG. 4 is configured to include the switchback path 24 (dotted line in FIG. 4), the extension path 25 (solid line in FIG. 4), the second curved path 31 (short broken line in FIG. 4), the third transport path 26 (long broken line in FIG. 4), and the second transport path 23 (two-dotted line in FIG. 4).

The extension path 25 extends from the switchback path 24 and is connected to the second curved path 31, serving a link from a nip position N1 of the first roller 32 and the first upstream side driven roller 35*a* to a nip position N3 of the second roller 33 and the second upstream side driven roller 36*a* to be described later.

the second curved path 31 is configured to include the second roller 33 that forms a path surface inside a curve, the second upstream side driven roller 36*a* that nips paper with the second roller 33 in a upstream side end portion of the second curved path 31 in the medium transport direction, and the second downstream side driven roller 36*b* that nips paper with the second roller 33 in downstream side end portion of the second curved path 31 in the medium transport direction. In other words, the second curved path 31 is a link from a nip position N3 of the second roller 33 and the second upstream side driven roller 36*a* to a nip position N4 of the second roller 33 and the second downstream side driven roller 36*b*. The length of the second curved path 31 (the length from a nip position N3 to a nip position N4) is Lb. The second roller 33 is driven to rotate by a drive source (not illustrated).

Further, the reference numeral 36*c* denotes the driven roller 36*c* that is disposed between the second upstream side driven roller 36*a* and the second downstream side driven roller 36*b* in a medium transport direction and nips paper with the second roller 33.

The second curved path 31 is connected to the third transport path 26. The third transport path 26 receives paper from the second curved path 31 and merges with the second transport path 23, serving as a section between a nip position N4 of the second roller 33 and the second downstream side driven roller 36*b* to a nip position N2 of the first roller 32 and the first downstream side driven roller 35*b*. The paper which is curved and reversed in the second curved path 31 passes through the third transport path 26 and the second transport path 23, and is fed to the recording area K by the pair of first feed rollers 13.

The second curved path 31 of the second reverse path 21 is configured to include the second roller 33, the second upstream side driven roller 36*a* and the second downstream side driven roller 36*b*, so that it is possible to transport paper along the second curved path 31 more securely and to perform decurling of paper effectively.

Further, as stated in the description of the first reverse path 20, the curvature of the first curved path 30 of the first reverse path 20 illustrated in FIG. 3 is lower than the curvature of the second curved path 31 of the second reverse path 21 illustrated in FIG. 4. In other words, the curvature of the second curved path 31 of the second reverse path 21 is greater than the curvature of the first curved path 30 of the first reverse path 20. Also, the length Lb of the second curved path 31 (FIG. 4) is shorter than the length La of the first curved path 30 (FIG. 3).

Therefore, the second curved path 31 is formed to curve more sharply than the first curved path 30.

As a result, in a case where paper is reversed by the second reverse path 21 (FIG. 4) having the sharply curved second curved path 31, it is possible to correct a curl of the paper more efficiently, compared with a case where paper is reversed by the first reverse path 20 (FIG. 3) having the smoothly curved first curved path 30.

Further, the curvature of the second curved path 31 is defined by the second roller 33 that forms a path surface inside the curve.

Further, in a case of duplex recording in which recording on the second surface is performed after the first surface is recorded on, depending on recording on the first surface, it is possible to select the first reverse path 20 or the second reverse path 21, having different curvatures of curved paths, and to perform decurling efficiently.

To be more specific, in a case where the duplex recording is executed, the paper is reversed by the first reverse path 20 (curvature of the first curved path 30 being low) when the amount of ink ejected onto the first surface of the paper is less than a predetermined threshold, while the medium is reversed by the second reverse path 21 (curvature of the second curved path 31 being high) when the amount of ink ejected onto the first surface of the paper is equal to or higher than a predetermined threshold.

The curl generated after the first surface of paper is recorded on tends to increase as the amount of ink ejected onto the first surface of the paper gets larger. Therefore, when the amount of ink ejected onto the first surface of paper is equal to or higher than a predetermined threshold and the curl of the paper becomes large, it is possible to correct the curl of the paper effectively by reversing the paper by the second reverse path 21 which includes the second curved path 31 having a large curvature, that is, a sharp curve.

On the other hand, in a sharply curved path, the paper being transported is likely to be stuck easily. Therefore, when the amount of ink ejected onto the first surface of paper is less than a predetermined threshold and the curl of the paper is small, it is possible to alleviate a concern that the paper may be stuck in a curved path by reversing the paper by the first reverse path 20 which includes the first curved path 30 having a low curvature, that is, a smooth curve.

Further, for example, the reverse path to be used may be changed depending on the stiffness of paper. In a case where a highly stiff paper is fed to a sharply curved path, there is a concern that transport resistance becomes large or that the paper is crumpled to cause a clogging. Further, in a highly stiff paper, the degree of curling accompanied by absorption of ink tends to be small. Therefore, in a case of a highly stiff paper, it is preferable that the paper be reversed by the first reverse path 20 having the first curved path 30 with a smooth curve.

Further, the second reverse path 21 (FIG. 4) has the extension path 25, the second curved path 31 and the third transport path 26, which are not included in the first reverse path 20 (FIG. 3). Therefore, the length of the second reverse path 21 is set to be longer than the length of the first reverse path 20 (FIG. 3).

In other words, the length in a case where the paper to be transported in the switchback direction by the pair of first feed rollers 13 passes through the first reverse path 20 and is fed to the recording area K, is set to be shorter than the length in a case where the paper passes through the second reverse path 21 and is fed to the recording area K.

Therefore, it is possible to improve throughput of recording in a case where paper is reversed by using the first reverse path 20, compared with a case where paper is reversed by using the second reverse path 21.

As described above, in a case where the duplex recording is executed, it is possible to reverse the paper by using the first reverse path 20 having a small length and to improve the throughput of recording when the amount of ink ejected onto the first surface of paper is less than a predetermined threshold.

On the other hand, when the amount of ink ejected onto the first surface of paper is equal to or higher than a predetermined threshold, it is possible to reverse the paper by the second reverse path 21 having a long length and extend a drying time to perform drying of the first surface reliably.

Here, in a case where paper is curled, for example, in a case where paper is nipped only by the pair of first feed rollers 13 and the leading end of the paper is in the recording area K of the recording head 10, a concern is that the second surface of the paper may come into contact with the head surface of the recording head 10. Further, in a case where the paper, nipped only by the pair of first feed rollers 13, floats up, a concern is that the paper may be crumpled to generate paper jam inside the path. When the leading end of paper is nipped by the second pair of feed rollers 14, the above described trouble hardly occurs.

In the present embodiment, to avoid the above-described trouble occurring when paper is nipped only by the pair of first feed rollers 13, a section between the pair of first feed rollers 13 and the pair of second feed rollers 14 is configured such that floating of paper is suppressed. A predetermined section, set between the pair of first feed rollers 13 and the pair of second feed rollers 14, in which floating of paper is suppressed, is referred to as floating suppression area L hereinafter.

Both the length La (FIG. 3) of the first curved path 30 which is the curved path of the first reverse path 20 and the length Lb (FIG. 4) of the second curved path 31 which is the curved path of the second reverse path 21 are set to be longer than the length of the floating suppression area L.

In the present embodiment, the floating suppression area L is a range L1 from a nip position N5 in the pair of first feed rollers 13 as "a pair of transport rollers" to a position 10*a* of the head surface having a plurality of nozzles 11 on the most downstream side in the medium transport direction.

That is, both the length La (FIG. 3) of the first curved path 30 of the first reverse path 20 and the length Lb (FIG. 4) of the second curved path 31 of the second reverse path 21 are set to be longer than the distance of a range L1 from a nip position N5 in the pair of first feed rollers 13 to a position 10*a* of the head surface having a plurality of nozzles 11 on the most downstream side in the medium transport direction.

Since both the length La of the first curved path 30 of the first reverse path 20 and the length Lb of the second curved path 31 of the second reverse path 21 are set to be longer than the floating suppression area L (=range L1), in a case where duplex recording is executed after the first surface is recorded on, it is possible to correct a curl of paper across a range longer than the floating suppression area L (range L1) regardless of whether the paper is reversed via either the first reverse path 20 or the second reverse path 21. Therefore, it is possible to suppress a floating of paper, nipped only by the pair of first feed rollers 13, in the floating suppression area L and to ease troubles of the second surface of paper rubbing against the head surface of the recording head 10 to result in paper jam.

Further, it is possible to set the floating suppression area L in a range of the first modification example to the fifth modification example to be described below.

First Modification Example

With reference to FIG. 7, a first modification example of the floating suppression area L will be described.

In the first modification example, the floating suppression area L is set in a range L2 from a nip position N5 of paper in the pair of first feed rollers 13 to the nozzle 11*a*, out of nozzles 11, positioned on the most downstream side (+Y side) in the medium transport direction. The range L2 is also a range from a nip position N5 to the downstream side end portion of the recording area K of the recording head 10.

Since both the length La of the first curved path 30 of the first reverse path 20 and the length Lb of the second curved path 31 of the second reverse path 21 are longer than the length of the range L2 as the floating suppression area L, it is possible to alleviate a concern that the paper nipped by the pair of first feed rollers 13 may float up to contact the nozzle 11 of the head surface of the recording head 10.

Second Modification Example

With reference to FIG. 8, a second modification example of the floating suppression area L will be described.

In the second modification example, the floating suppression area L is set in a range L3 from a nip position N5 of paper in the pair of first feed rollers 13 to a nip position N6 of the paper in the pair of second feed rollers 14.

Since both the length La of the first curved path 30 of the first reverse path 20 and the length Lb of the second curved path 31 of the second reverse path 21 are longer than the length of the range L3 as the floating suppression area L, it is possible to suppress the floating of paper after the paper is nipped only by the pair of first feed rollers 13 until the leading end of the paper is nipped by the pair of second feed rollers 14, and to ease the trouble of the paper rubbing against the head surface of the recording head 10 to result in paper jam.

Further, it is possible to nip the leading end of the paper in the pair of second feed rollers 14 reliably.

Third Modification Example

With reference to FIG. 9, a third modification example of the floating suppression area L will be described.

In the third modification example, the second driven roller 14*b* constituting the pair of second feed rollers 14, as illustrated in FIG. 9, is rotatably supported by the second driven roller support member 38. The second driven roller support member 38 constitutes a path surface on the upper side of paper discharge path 18.

Therefore, the floating suppression area L is set in a range L4 from a nip position N5 of paper in the pair of first feed rollers 13 to a position 38*a* on the most upstream (−Y side) side of the second driven roller support member 38 in the medium transport direction, which supports the second driven roller 14*b* which constitutes the pair of second feed rollers 14.

In a case where the leading end of paper exceeds a position 38*a* on the most upstream side (−Y side) of the second driven roller support member 38 in the medium transport direction, it is possible for the second driven roller support member 38 to regulate the paper floating up to, or beyond, a predetermined level.

Since both the length La of the first curved path 30 in the first reverse path 20 and the length Lb of the second curved path 31 in the second reverse path 21 are longer than the length of an area L4 as floating suppression area L, it is possible to suppress the paper floating up and to ease the trouble of paper rubbing against the head surface of the recording head 10 and thus to result in paper jam, from the time the paper gets nipped only by the pair of first feed rollers 13 until the leading end of the paper gets positioned below the second driven roller support member 38.

Further, it is possible to reliably nip the leading end of paper by the pair of second feed rollers 14.

Fourth Modification Example

With reference to FIG. 10, a fourth modification example of the floating suppression area L will be described.

In the printer 1, the pair of first feed rollers 13, as illustrated in FIG. 10, is configured such that a tangent T at a nip position N5 at which paper is nipped intersects with the medium support member 12 in some cases.

In a case where the tangent T at a nip position N5 of the pair of first feed rollers 13 is configured to intersect with the medium support member 12, the paper to be transported by the pair of first feed rollers 13 is transported thereto, being pressed against the medium support member 12, and, thus, a posture of the paper on the medium support member 12 is stabilized.

Since paper to be transported by the pair of first feed rollers 13 is transported toward the medium support member 12 up to a position A at which the tangent T intersects with the medium support member 12, floating up of paper hardly occurs. Therefore, in the fourth modification example, the floating suppression area L is set in a range L5 from a position A at which the tangent T intersects with the medium support member 12 to the nozzle 11*a*, out of a plurality of nozzles 11, which is positioned on the most downstream side in the medium transport direction.

Since both the length La (FIG. 3) of the first curved path 30 of the first reverse path 20 and the length Lb (FIG. 4) of the second curved path 31 of the second reverse path 21 are longer than a length of the range L5 as the floating suppression area L, it is possible to ease the trouble of the leading end of paper floating up to rub against the head surface of the recording head 10 and thus to result in paper jam, compared with a case where paper is nipped only by the pair of first feed rollers 13.

Since both the length La (FIG. 3) of the first curved path 30 of the first reverse path 20 and the length Lb (FIG. 4) of the second curved path 31 of the second reverse path 21 are longer than a length of the range L5 as the floating suppression area L, it is possible to ease a trouble of paper floating up to rub against the head surface of the recording head 10 and thus to result in paper jam, compared with a case where paper is nipped only by the pair of first feed rollers 13.

Fifth Modification Example

With reference to FIG. 11, a fifth modification example of the floating suppression area L will be described.

In the fifth modification example, the floating suppression area L is set in a range L6 from a position A at which a tangent T intersects with the medium support member 12 to a position 38*a* of the second driven roller support member 38 on the most upstream side in the medium transport direction.

Since both the length La (FIG. 3) of the first curved path 30 of the first reverse path 20 and the length Lb (FIG. 4) of the second curved path 31 of the second reverse path 21 are longer than a length of the range L6 as the floating suppression area L, it is possible to further suppress paper floating up and to ease the trouble of paper rubbing against the head surface of the recording head 10 to result in paper jam in a case where the paper is nipped only by the pair of first feed rollers 13.

Further, it is possible to nip the leading end of paper reliably by the pair of second feed rollers 14.

Other Configurations in the First Reverse Path

In this embodiment, as illustrated in FIG. 3, the first transport path 22 (one-dotted chain line in FIG. 3) through which paper to be fed from the medium tray 6 passes merges with the first reverse path 20.

More specifically, the first transport path 22, after intersecting with the extension path 25 (solid line in FIG. 4) as illustrated in FIG. 4, merges with the first curved path 30 of the first reverse path 20 as illustrated in FIG. 3.

Since the first transport path 22, through which paper to be fed from the medium tray 6 passes, merges with the first reverse path 20 after intersecting with the extension path 25, the first reverse path 20 being shorter than the second reverse path 21 to the recording area K, it is possible to shorten the medium transport distance when paper is fed from the medium tray 6 and recording is performed on the first surface. Therefore a good throughput can be obtained in the printer 1.

Further, in the embodiment, the length of the first reverse path 20 is set on a basis of the maximum size of paper in a longitudinal direction that can be recorded on in the printer 1. For example, the length of the first reverse path 20 is set to be the smallest length in which paper of the maximum size can be reversed. As a result, it is possible to obtain a good throughput both at a time of recording on the first surface and at a time of recording on the second surface when paper is reversed by passing through the first reverse path 20 for duplex recording in the printer 1.

A first flap 40 and a second flap 41 as illustrated in FIG. 5 and FIG. 6 are provided at the intersection of the first transport path 22 and the first curved path 30, and are configured to switch the switchback path 24 and feed a transported paper either to the first curved path 30 or the extension path 25.

The first flap 40 and the second flap 41 are configured such that free ends 40*b* and 41*b* swing with swing pivots 40*a* and 41*a* serving as a pivot of each respectively.

As illustrated in FIG. 5, in a case where both the first flap 40 and the second flap 41 swing upward (+Z direction), paper is fed from the switchback path 24 to the first curved path 30. Further, in this state, paper to be fed from the medium tray 6 can merge with the first curved path 30 from the first transport path 22.

Further, as illustrated in FIG. 6, in a case where both the first flap 40 and the second flap 41 swing downward (−Z direction), paper is fed to the extension path 25 from the switchback path 24.

Further, in the embodiment the first reverse path 20 illustrated in FIG. 3 and the second reverse path 21 illustrated in FIG. 4 are configured not to include a path that has a tendency to curl the medium such that the second surface side is rolled inward. In other words, the first reverse path 20 and the second reverse path 21 do not include a path that curves with a curvature which tends to curl paper contrary to a curving direction of the first curved path 30 and the second curved path 31.

As a result, it is possible to perform decurling more effectively by the first curved path 30 or the second curved path 31. It is also possible to alleviate a concern that the paper decurled by the first curved path 30 or the second curved path 31 may get curled again.

Further, in the printer 1, it is preferable that the first reverse path 20 and the second reverse path 21 be configured as a single unit. A configuration of the first reverse path 20 and the second reverse path 21 as one unit will make it possible to facilitate assembly of the apparatus.

Further, in the first embodiment, as illustrated in FIGS. 2 to 4, the second roller 33 and the first roller 32 overlap in the height direction (Z axis direction). However, as illustrated in FIG. 12, it is also possible that the second roller 33 and the first roller 32 are disposed to overlap in the apparatus depth direction (Y axis direction). In FIG. 12, the second roller 33 is disposed above the first roller 32, but may be disposed under the first roller 32.

Further, the configuration of the first reverse path 20 in FIG. 12 is the same as in FIGS. 2 to 4. The second reverse path 21A illustrated in FIG. 12 is provided with a branch path 42 (thick solid line in FIG. 12) that branches at a nip position of the first roller 32 and a driven roller 35*c*, both in the first curved path 30, a second curved path 31A (broken line in FIG. 12), and a merge path 43 (thick solid line in FIG. 12) that merges with the second transport path 23.

Further, it is possible to provide the first reverse path 20 and the second reverse path 21 of the disclosure on the downstream side (+Y direction side) in the medium transport direction with respect to the recording head 10. That is, it is possible to feed the medium, after the first surface is recorded on, to either one of the first reverse path 20 and the second reverse path 21 without transporting the medium in the switchback direction.

Further, it goes without saying that the disclosure is not limited to the embodiments described above, that a variety of modifications is possible within the scope of the disclosure described in the Claims and that these are also included within the scope of the disclosure.

What is claimed is:

1. A recording apparatus comprising:

a recording head that is provided with a plurality of nozzles and performs recording by ejecting liquid onto a medium from the nozzles;

a pair of transport rollers that transports the medium toward the recording head; and a first path and a second path that cause the medium, transported in the medium transport direction with a first surface facing the recording head, to be curved with the first surface being as an inside at a position on an upstream side of a position of the recording head in the medium transport direction, and reverse the medium so that a second surface which is a surface opposite to the first surface of the medium faces the recording head to transport the medium again toward the recording head, wherein both a length of a first curved path included in the first path and a length of a second curved path included in the second path are longer than a distance from a nip position in the pair of transport rollers to a most downstream side position of a head surface having the plurality of nozzles in the medium transport direction, and wherein a curvature of the second curved path is greater than a curvature of the first curved path.

2. The recording apparatus according to claim 1, wherein, in a case where duplex recording is executed in which recording is performed on the second surface of the medium after the first surface of the medium is recorded on, the medium is reversed by the first path when an amount of the liquid ejected onto the first surface of the medium is less than a predetermined threshold, and the medium is reversed by the second path when the amount the liquid ejected onto the first surface of the medium is equal to or higher than the predetermined threshold.

3. The recording apparatus according to claim 1, wherein the pair of transport rollers is configured to be capable of transporting the medium both in the medium transport direction toward a recording area of the recording head and in a switchback direction contrary to the medium transport direction, and wherein the first path and the second path are configured to include a switchback path through which the medium being transported by the pair of transport rollers in the switchback direction passes and to feed the medium to the first curved path and the second curved path via the switchback path.

4. The recording apparatus according to claim 3, wherein, when the medium is transported by the pair of transport rollers in the switchback direction, a path length in a case where the medium is fed to the recording area via the first path is set to be shorter than a length in a case where the medium is fed to the recording area via the second path.

5. The recording apparatus according to claim 4, further comprising:

a medium accommodation unit that accommodates the medium; and a first transport path through which the medium fed from the medium accommodation unit passes, wherein the switchback path is connected to both the first curved path and an extension path that extends into the second curved path, on the downstream side in the switchback direction, wherein the first path includes the switchback path, the first curved path, and a second transport path that receives the medium from the first curved path and feeds the medium to the recording area of the recording head, wherein the second path includes the switchback path, the extension path, the second curved path, a third transport path that receives the medium from the second curved path and merges with the second transport path, and the second transport path, and wherein the first transport path merges with the first path after intersecting with the extension path.

6. The recording apparatus according to claim 1, wherein the first curved path includes a first roller that forms a path surface inside a curve, a first upstream side driven roller that nips the medium with the first roller in an upstream side end portion of the first curved path in the medium transport direction, and a first downstream side driven roller that nips the medium with the first roller in a downstream side end portion of the first curved path in the medium transport direction, and wherein the second curved path includes a second roller that forms a path surface inside a curve, a second upstream side driven roller that nips the medium with the second roller in an upstream side end portion of the second curved path in the medium transport direction, and a second downstream side driven roller that nips the medium with the second roller in a downstream side end portion of the second curved path in the medium transport direction.

7. The recording apparatus according to claim 6, further comprising:

a third roller that is disposed on a downstream side in the medium transport direction with respect to the first roller and feeds the medium after a reversion toward the recording head side, and has a diameter same as that of the first roller.

8. The recording apparatus according to claim 1, wherein the first path and the second path are configured not to include a path that has a tendency to curl the medium such that the second surface side is rolled inward.

9. A recording apparatus comprising:

a recording head that includes a plurality of nozzles and performs recording by ejecting liquid onto a medium from the nozzles;

a pair of first feed rollers that is disposed on an upstream side of the recording head in the medium transport direction and transports the medium to a recording area of the recording head;

a pair of second feed rollers that is disposed on a downstream side of the recording head in the medium transport direction and transports the medium to the downstream side; and a first path and a second path that cause the medium, transported in the medium transport direction with a first surface facing the recording head, to be curved with the first surface being as an inside at a position on an upstream side of a position of the recording head in the medium transport direction, and reverse the medium so that a second surface which is a surface opposite to the first surface of the medium faces the recording head to transport the medium again toward the recording head, wherein both a length of a first curved path included in the first path and a length of a second curved path included in the second path are longer than a length of a floating suppression area that is set between the pair of first feed rollers and the pair of second feed rollers, and a curvature of the second curved path is greater than a curvature of the first curved path.

10. The recording apparatus according to claim 9, wherein the floating suppression area is set in a range from a nip position of the medium in the pair of first feed rollers to the nozzle, out of the plurality of nozzles, which is positioned on a most downstream side in the medium transport direction.

11. The recording apparatus according to claim 9, wherein the floating suppression area is set in a range from a nip position of the medium in the pair of first feed rollers to a nip position of the medium in the pair of second feed rollers.

12. The recording apparatus according to claim 9, further comprising:

a second driven roller that constitutes the pair of second feed rollers and comes into contact with a surface of the medium on which recording is performed by the recording head to be driven to rotate; and a second driven roller support member that supports the second driven roller, wherein the floating suppression area is set in a range from a nip position of the medium in the pair of first feed rollers to a position of the second driven roller support member on a most upstream side in the medium transport direction.

13. The recording apparatus according to claim 9, further comprising:

a medium support member that is disposed to face the recording head and supports the medium, wherein the pair of first feed rollers is configured such that a tangent at a nip position where the medium is nipped intersects with the medium support member, and wherein the floating suppression area is set in a range from a position where the tangent intersects with the medium support member to the nozzle, out of the plurality of nozzles, which is positioned on a most downstream side in the medium transport direction.

14. The recording apparatus according to claim 9, further comprising:

a second driven roller that constitutes the pair of second feed rollers and comes into contact with a surface of the medium on which recording is performed by the recording head to be driven to rotate;

a second driven roller support member that supports the second driven roller; and a medium support member that is disposed to face the recording head and supports the medium, wherein the pair of first feed rollers is configured such that a tangent at a nip position where the medium is nipped intersects with the medium support member, and wherein the floating suppression area is set in a range from a position where the tangent intersects with the medium support member to a position of the second driven roller support member on a most upstream side in the medium transport direction.

* * * * *